US012448170B2

(12) United States Patent
Couture

(10) Patent No.: US 12,448,170 B2
(45) Date of Patent: Oct. 21, 2025

(54) RETAIL READY PACKAGES FOR MULTI-SIDED PRODUCTS

(71) Applicant: WestRock Shared Services, LLC, Atlanta, GA (US)

(72) Inventor: David G. Couture, Hoschton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 650 days.

(21) Appl. No.: 17/768,900

(22) PCT Filed: Oct. 15, 2020

(86) PCT No.: PCT/US2020/055838
§ 371 (c)(1),
(2) Date: Apr. 14, 2022

(87) PCT Pub. No.: WO2021/076799
PCT Pub. Date: Apr. 22, 2021

(65) Prior Publication Data

US 2024/0101304 A1 Mar. 28, 2024

Related U.S. Application Data

(60) Provisional application No. 62/915,264, filed on Oct. 15, 2019.

(51) Int. Cl.
*B65D 5/54* (2006.01)
*B65D 5/02* (2006.01)

(52) U.S. Cl.
CPC ..... *B65D 5/5415* (2013.01); *B65D 5/029* (2013.01)

(58) Field of Classification Search
CPC .... B65D 5/5415; B65D 5/029; B65D 5/5445; B65D 5/0227; B65D 2301/00; B65D 5/0095; B65D 5/5038; B65D 5/701
USPC ..... 229/109, 122.23, 157, 198.2, 235; 426/111
See application file for complete search history.

(56) References Cited

U.S. PATENT DOCUMENTS

2020/0115098 A1* 4/2020 Burks ..... B65D 5/5445
2020/0189788 A1* 6/2020 Cline ..... B65D 5/20
2021/0284383 A1* 9/2021 Cline ..... B31B 50/26
(Continued)

FOREIGN PATENT DOCUMENTS

CA 3002294 A1 11/2018
EP 2322438 A2 5/2011
(Continued)

OTHER PUBLICATIONS

PCT International Search Report dated Feb. 4, 2021.

*Primary Examiner* — Christopher R Demeree
(74) *Attorney, Agent, or Firm* — Neil G. Cohen; Rohini K. Garg

(57) ABSTRACT

A retail ready package (100) for shipping and displaying products, which includes front (18) and rear panels (14) each having at least six sides and being spaced apart from one another along a longitudinal axis of the package when the package is in a shipping condition, wherein the front and rear panels each have a perforation line (90) associated therewith that facilitate a conversion of the package into an open-topped product display tray having a generally hexagonal shaped cross-section, which extends in a plane that is transverse to the longitudinal axis of the package.

19 Claims, 18 Drawing Sheets

(56) References Cited

U.S. PATENT DOCUMENTS

| | | | | |
|---|---|---|---|---|
| 2021/0284384 | A1* | 9/2021 | Couture | B65D 5/5445 |
| 2021/0339904 | A1* | 11/2021 | Simpkins | B65D 5/02 |

FOREIGN PATENT DOCUMENTS

| | | | |
|---|---|---|---|
| WO | 200185567 | A1 | 11/2001 |
| WO | 2018106749 | A1 | 6/2018 |

* cited by examiner

RETAIL READY PACKAGES FOR MULTI-SIDED PRODUCTS

CROSS-REFERENCE TO RELATED APPLICATION

This application claims the benefit of priority to U.S. Provisional Patent Application Ser. No. 62/915,264 filed Oct. 15, 2019, the disclosure of which is herein incorporated by reference in its entirety.

BACKGROUND OF THE INVENTION

1. Field of the Invention

The subject invention is directed to product packaging, and more particularly, to retail ready packages configured for shipping and displaying six-sided products and eight-sided products in an upright position.

2. Description of Related Art

Retailers, such as big-box stores, superstores and warehouse clubs sell large quantities of fast moving consumer goods. These retailers often want to have items shipped from their distribution centers to the stores in unit loads and bulk boxes that can be stocked without handling of the merchandise.

The goal for corrugated shipping containers is to put case goods directly onto shelves and stocking locations without individually handling the unit packs or primary packages. To this end, retailers often require products to come in shelf ready packaging to reduce stocking costs and save labor expenses. Shelf-ready packaging, also known as, retail ready packaging refers to the packaging of a product so that it is delivered to a retailer in packaging optimized for efficient stocking and sale.

It would be beneficial to provide a retail ready package for shipping and displaying multi-sided products, such as six-sided and eight-sided frozen food packages in an upright position.

SUMMARY OF THE DISCLOSURE

The subject invention is directed to a new and useful retail ready package for shipping and displaying products, such as, for example, frozen food packages or the like. The retail ready package includes front and rear panels each having at least six sides and being spaced apart from one another along a longitudinal axis of the package when the package is in a shipping condition. The front and rear panels each have a perforation line associated therewith that facilitate a conversion of the package into an open-topped product display tray having a generally hexagonal shaped cross-section, which extends in a plane that is transverse to the longitudinal axis of the package.

In one embodiment of the package, the front and rear panels both have six sides. In another embodiment of the invention, the front and rear panels both have eight sides. Preferably, the perforation line associated with the front panel delineates a removable front panel portion and a remaining front panel portion. The front panel preferably includes an opening above the perforation line associated therewith for aiding in opening the perforation line to facilitate the conversion of the package into an open-topped product display tray.

In one embodiment of the invention, the perforation line associated with the rear panel facilitates separation of the rear panel from a top panel of the package. In another embodiment of the invention, the perforation line associated with the rear panel delineates a removable rear panel portion and a remaining rear panel portion.

Preferably, the package has a bottom panel with a rectangular center portion, first and second inner side bottom portions, and first and second outer side bottom portions. In an embodiment of the invention, the bottom panel has a longitudinal perforation line that facilitates a separation of the product display tray into two separate open-topped trays. In such an instance, the front panel includes a central gap and the rear panel includes a central perforation line in the remaining portion thereof to facilitate the separation of the product display tray into two separate open-topped product display trays.

The subject invention is also directed to a die-cut blank for forming a retail ready package, which includes a top panel, a bottom panel, a front panel and a rear panel. The top panel of the blank has a rectangular center portion, a first top side flap foldably connected to a first side edge of the rectangular center portion, and a second top side flap foldably connected to a second side edge of the rectangular center portion.

The rear panel of the blank has a rear panel having a center portion with at least six sides foldably connected to a top rear edge of the rectangular center portion of the top panel, a first rear side flap foldably connected to a first side edge of the center portion of the rear panel, and second rear side flap foldably connected to a second side edge of the center portion of the rear panel.

The bottom panel of the blank has a bottom panel has a rectangular center portion foldably connected to a bottom rear edge of the center portion of the rear panel, a first inner side bottom portion foldably connected to a first side edge of the rectangular center portion of the bottom panel, a first outer side bottom portion foldably connected to the first inner side bottom portion, a second inner side bottom portion connected to a second side edge of the rectangular center portion of the bottom panel, and a second outer side bottom portion foldably connected to the second inner side bottom portion.

The front panel of the blank has a center portion with at least six sides foldably connected to the a bottom front edge of the rectangular center portion of the bottom panel, a first front side flap foldably connected to a first edge of the center portion of the front panel, a second front side flap foldably connected to a second edge of the center portion of the front panel, and a front flap foldably connected to a top front edge the center portion of the front panel.

A perforation line extends across the front panel through the first side flap, the center portion and the second side flap thereof, to define a removable part of the front panel and a remaining part of the front panel, and the center portion of the rear panel is foldably connected to the top rear edge of the rectangular center portion of the top panel along a top perforation line to facilitate a separation of the top panel from the rear panel together with the removable part of the front panel. Preferably, an opening is formed in the center portion of the front panel below the gap in the perforation line to aide in splitting the front panel in half.

Preferably, a gap interrupts the perforation line within the center portion of the front panel. In an embodiment of the invention, a continuous perforation line extends across the rear panel through the first side flap, the center portion and the second side flap thereof, to define a removable part of the rear panel. In another embodiment of the invention, a perforation line bisects the center portion of the bottom panel, and a perforation line bisects the center portion of the rear panel between the continuous perforation line in the rear panel and the bottom rear edge of the center portion of the bottom panel.

It is envisioned that the center portion of the rear panel and the center portion of the front panel can both have either six sides or eight sides. In embodiments of the invention wherein the center portion of the front and rear panels has eight sides, the top panel further includes a first outer top side flap foldably connected to an outer side edge of the first top side flap, and a second outer top side flap foldably connected to an outer side edge of the second top side flap.

These and other features of the retail ready packages of the subject invention and the die-cut blanks for forming the packages will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those skilled in the art will readily understand how to make and use the retail ready packages of the subject invention without undue experimentation, preferred embodiments thereof will be described in detail herein below with reference to the figures wherein.

DETAILED DESCRIPTION OF THE PREFERRED EMBODIMENTS

Figure 1:
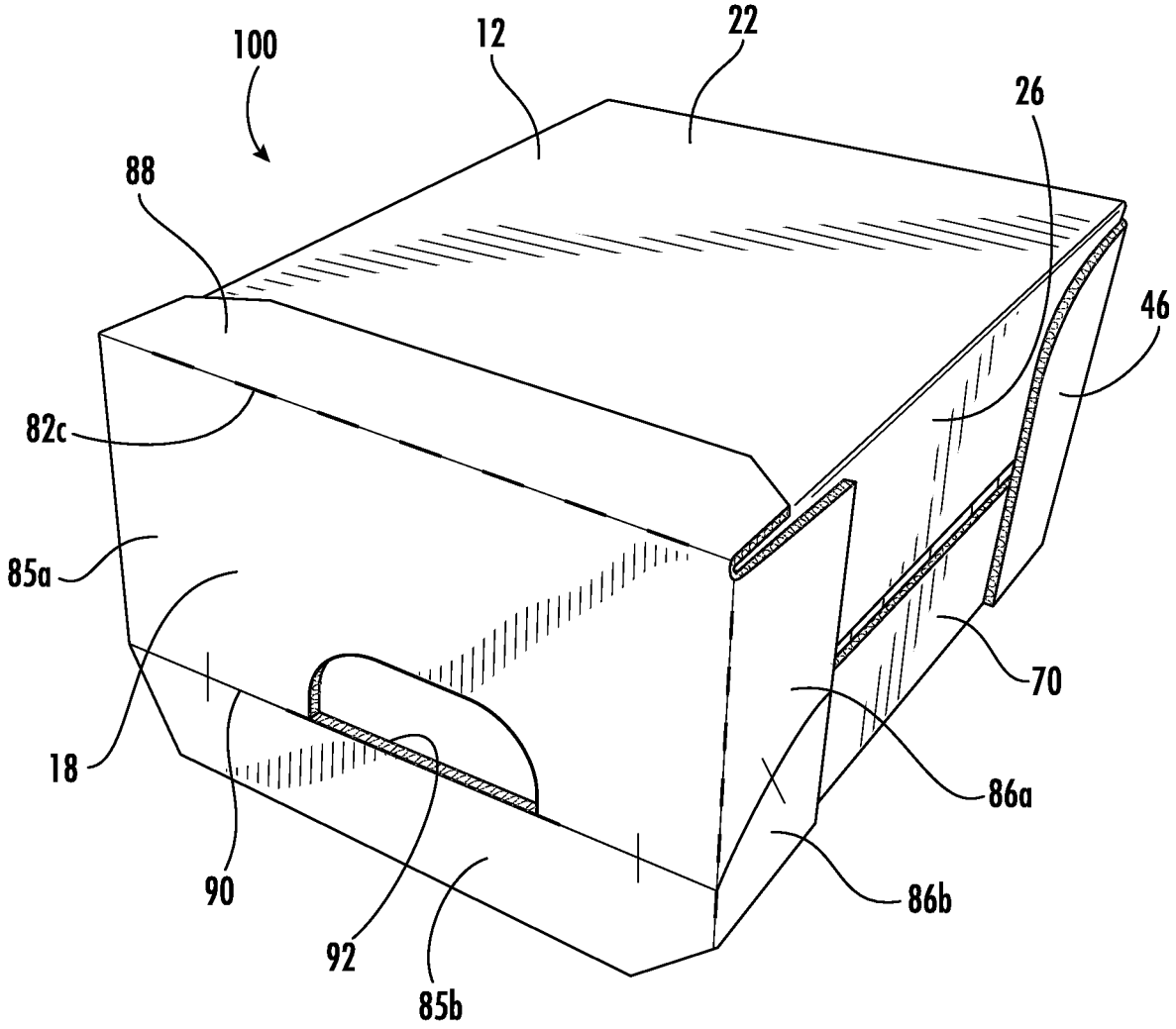
FIG. 1 is a perspective view of a retail ready package constructed in accordance with a preferred embodiment of the subject invention that is configured to ship and display six-sided products.

Referring now to the drawings wherein like reference numerals identify similar structural features or elements of the various embodiment of the subject invention, there is illustrated in FIG. 1 a retail ready package constructed in accordance with a preferred embodiment of the subject invention, which is designated generally by reference numeral 100. The retail ready package 100 is adapted and configured for efficiently loading, shipping and subsequently displaying six-sided products in an upright position on a shelf or display unit in a retail store. The retail ready package 100 is particularly well-suited for shipping and displaying frozen food products, such as containers of frozen vegetables or prepared soups.

Moreover, as discussed in detail below, because of the unique configuration of the retail ready package 100, when a plurality of such packages are shipped together on a pallet in a refrigerated transport container, the openings or gaps that are formed between the oppositely angled corners of adjacent packages allow cold air to flow throughout the pallet, ensuring that the frozen food items contained within the packages on the pallet will remain at a sufficiently low temperature to prevent the food items from thawing during shipping, which would be undesirable.

Figure 2:
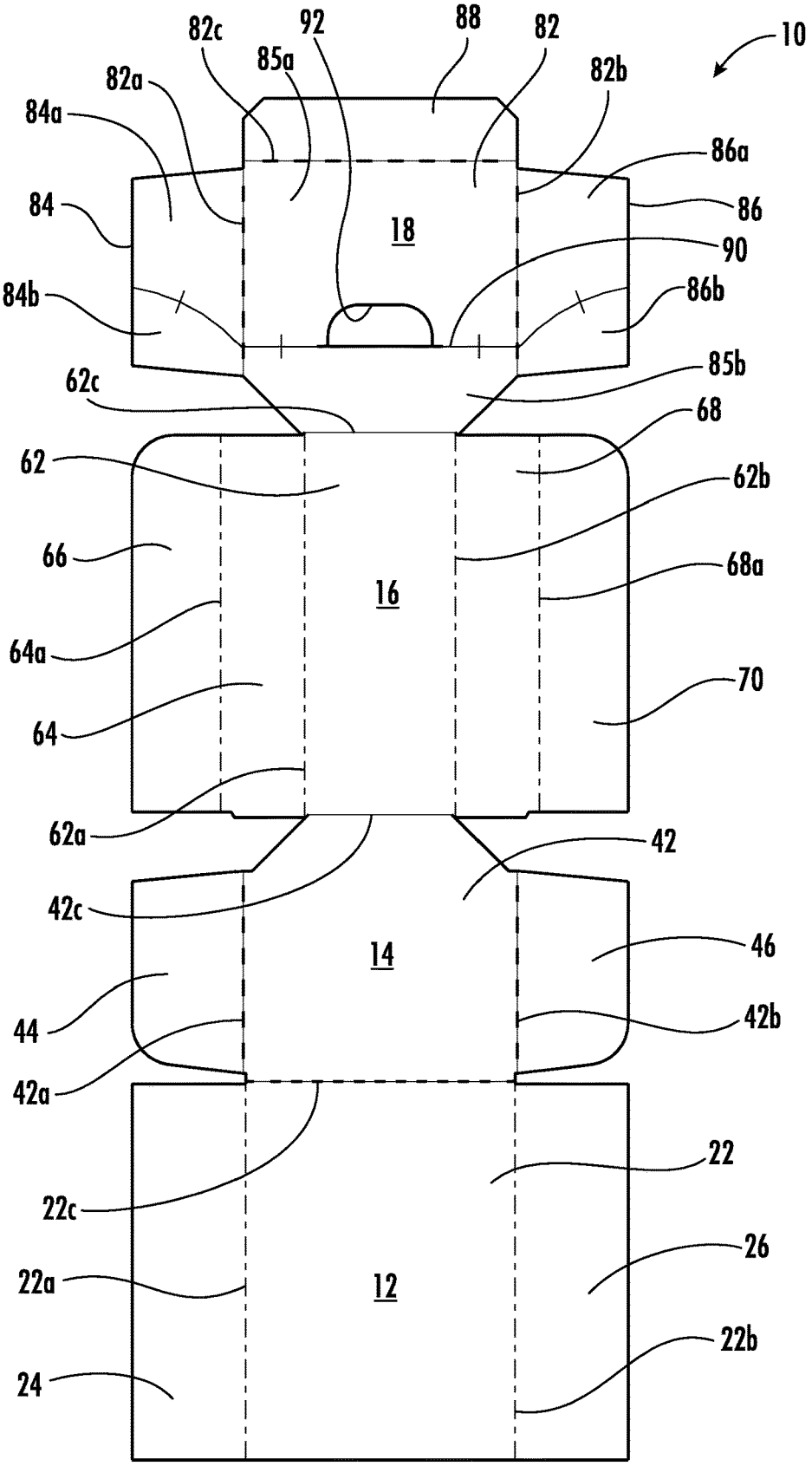
FIG. 2 is a plan view of a die-cut blank for forming the retail ready package shown in FIG. 1.

Referring now to FIG. 2, there is illustrated a die-cut cardboard blank 10 for forming the retail ready package 100 of the subject invention. The blank 10 includes a top panel 12 having a rectangular center portion 22, a first top side flap 24 foldably connected to a first side edge 22*a* of the rectangular center portion 22, and a second top side flap 26 foldably connected to a second side edge 22*b* of the rectangular center portion 22.

The blank 10 further includes a rear panel 14 having a hexagonal center portion 42 foldably connected to a top rear edge 22*c* of the rectangular center portion 22 of the top panel 12, a first rear side flap 44 foldably connected to a first side edge 42*a* of the hexagonal center portion 42, and second rear side flap 46 foldably connected to a second side edge 42*b* of the hexagonal center portion 42.

The blank 10 further includes a bottom panel 16 having a rectangular center portion 62 foldably connected to a bottom rear edge 42*c* of the hexagonal center portion 42 of the rear panel 14, a first inner side bottom panel 64 foldably connected to a first side edge 62*a* of the rectangular center portion 62 of the bottom panel 16, a first outer side flap 66 foldably connected to the first inner side bottom panel 64 along a fold line 64*a*, a second inner side bottom panel 68 connected to a second side edge 62*b* of the rectangular center portion 62 of the bottom panel 16, and a second outer side flap 70 foldably connected to the second inner side bottom panel 68 along a fold line 68*a*.

The blank 10 further includes a front panel 18 having a hexagonal center portion 82 foldably connected to the a bottom front edge 62*c* of the rectangular center portion 62 of the bottom panel 16, a first front side flap 84 foldably connected to a first edge 82*a* of the hexagonal center portion 82 of the front panel 18, a second front side flap 86 foldably connected to a second edge 82*b* of the hexagonal center portion 82 of the front panel 18, and a front flap 88 foldably connected to a top front edge 82*c* the hexagonal center portion 82 of the front panel 18.

A perforation line 90 extends across the front panel 18 through the first side flap 84, the hexagonal center portion 82 and the second side flap 86 thereof to divide the first side flap 84 into a removable portion 84*a* and remaining portion 84*b*, to divide the center portion 82 into a removable portion 85*a* and a remaining portion 85*b*, and to divide the second side flap 86 into a removable portion 86*a* and a remaining portion 86*b*. The perforation line 90 is interrupted by a central gap, where a hand-sized opening 92 is formed to aide in opening the perforation line 90 to initiate separation of the removable portions 84*a*, 85*a*, 86*a* of the front panel 18 from the remaining portions thereof 84*b*, 85*b*, 86*b*, as explained in more detail below with respect to FIG. 6. In addition, the top rear edge 22*c* of the rectangular center portion 22 of the top panel 12 is defined by a top perforation line that facilitates the complete separation of the top panel 12 from the rear panel 14 together with the removable portions 84*a*, 85*a*, 86*a* of the front panel 18.

Figure 3:
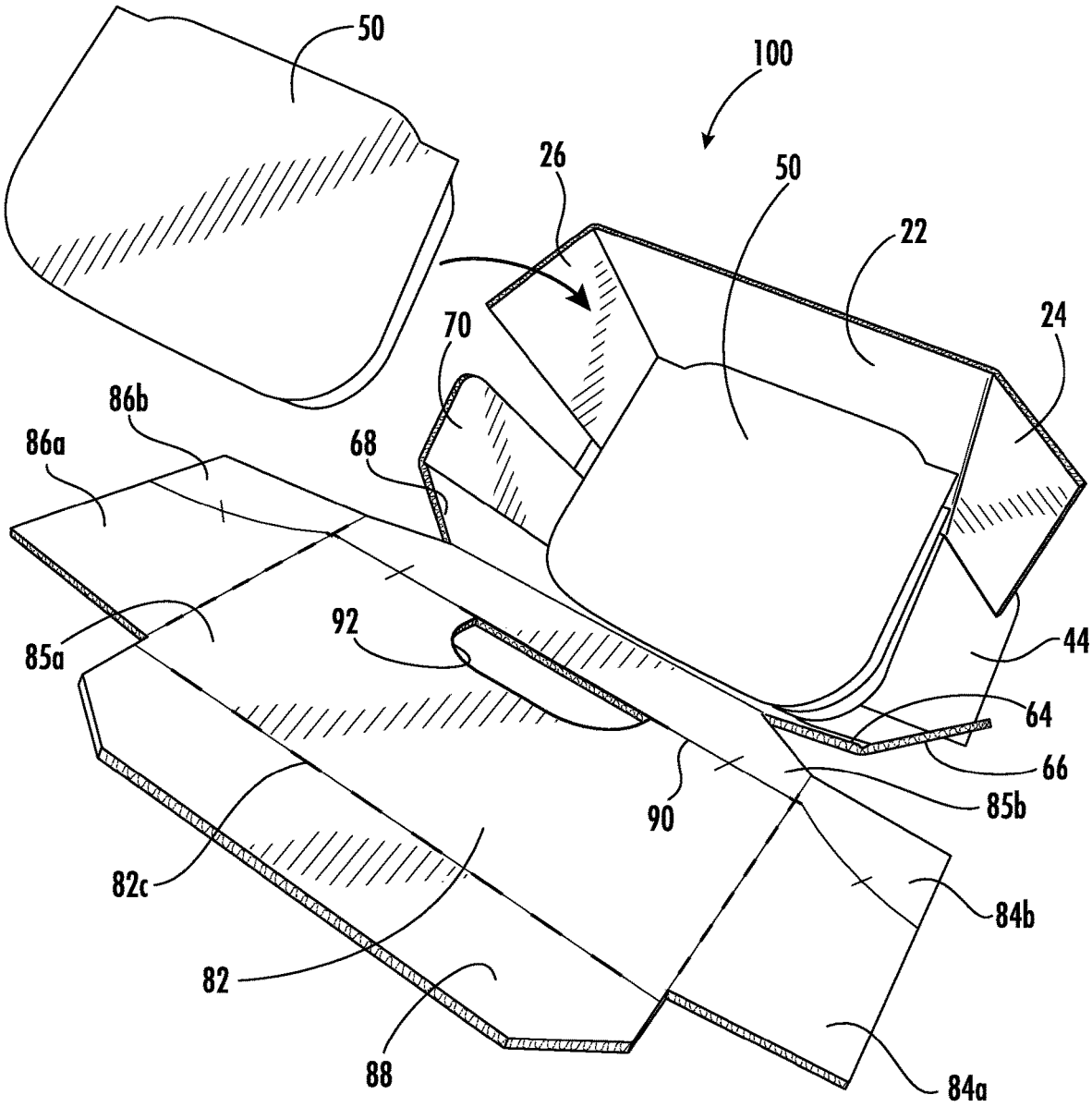
FIG. 3 is a perspective view of a retail ready package partially constructed from the blank of FIG. 2, as six-sided products are loaded into the package.
Figure 4:
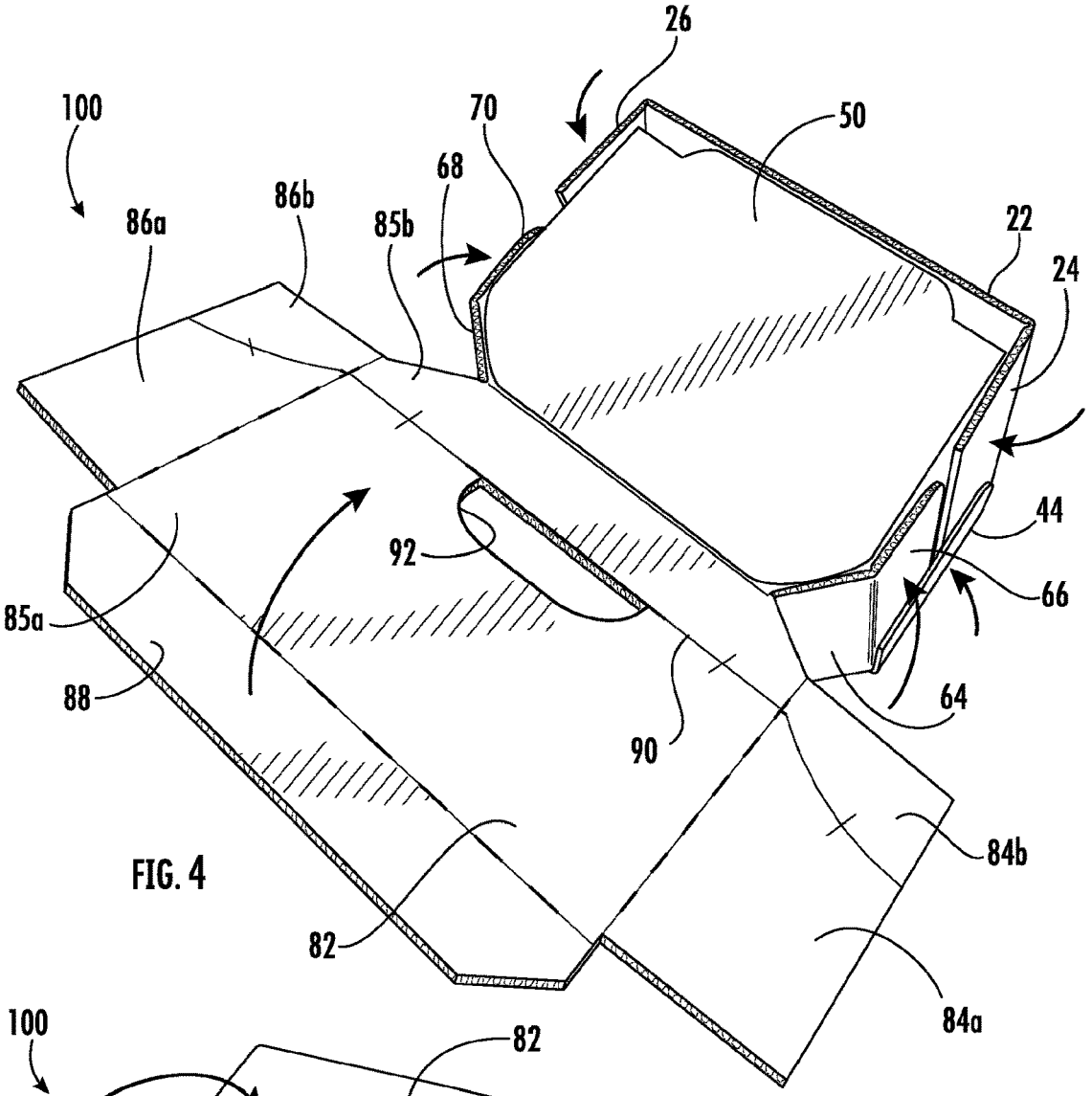
FIG. 4 is a perspective view of the retail ready package shown in FIG. 3, as the flaps are folded and sealed with glue.
Figure 5:
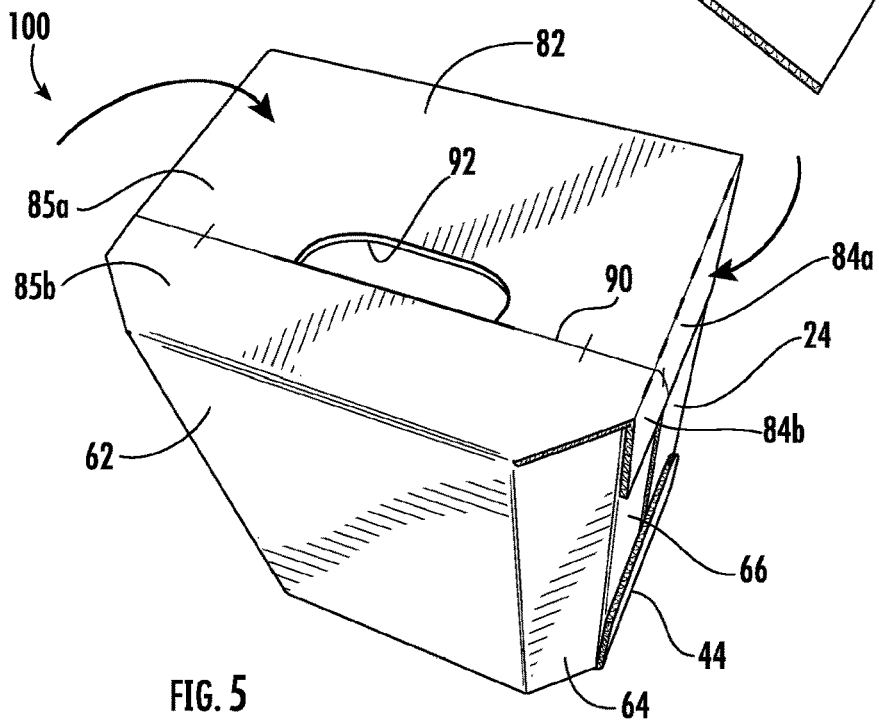
FIG. 5 is a perspective view of the retail ready package shown in FIG. 3, in a fully assembled and loaded condition ready for shipping.

Referring now to FIGS. 3 through 5, there is illustrated the steps of loading and forming the retail ready package 100 of the subject invention from the die-cut blank 10 shown in FIG. 2. Initially, the panels of the blank 10 are folded and erected into the unsealed loading condition shown in FIG. 3. Thereupon, a plurality of generally six-sided products, such as frozen food packages 50 are loaded into the unsealed carton 100. Thereafter, as shown in FIG. 4, the side flaps of the top and bottom panels 12 and 16 are folded into place and the side flaps 44 and 46 of the rear panel 14 are glued to adjacent interfacing outer surface portions of the top and bottom panels 12 and 16.

During the construction of the package 100, it is preferable not to use glue in the junction areas between the top and rear side flaps 24 and 44, as well as in the junction areas between the top and rear side flaps 26 and 46. This will enable the removable upper portions of the package 100 to swing open relative to the remaining lower portions of the package 100, when the package is converted into a product display tray, as shown for example in FIG. 7. Finally, the front panel 18 is folded into place and the side flaps 84 and 86 of the front panel 18 thereof are glued to adjacent interfacing portions of the top and bottom panels 12 and 16, as shown in FIG. 5. At such a time, the fully loaded and sealed retail ready package 100 can be palletized and shipped.

Figure 6:
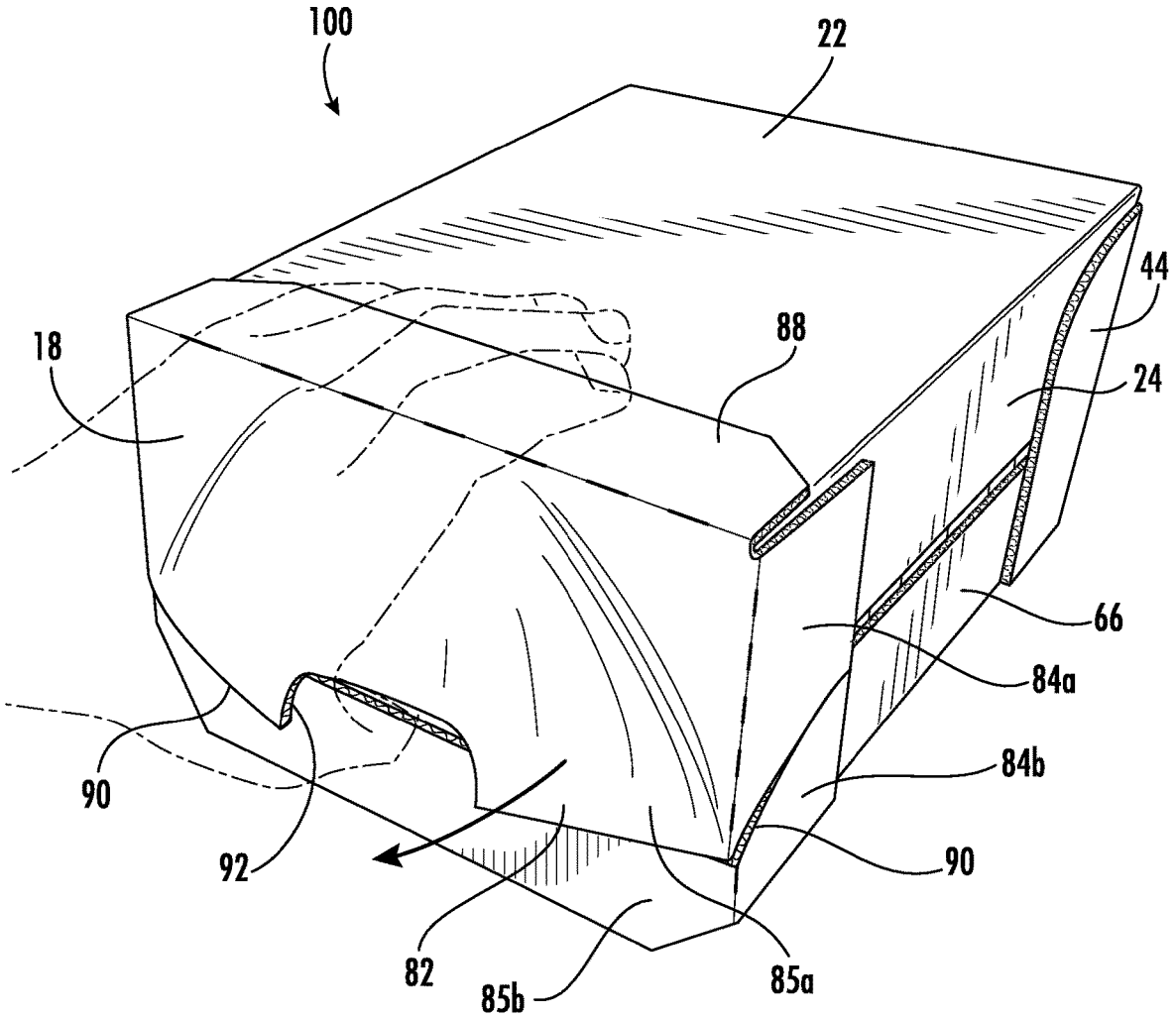
FIG. 6 is a perspective view of the retail ready package of FIG. 5, as the front panel is pulled upward to open the package.

Referring now to FIG. 6, when the package 100 arrives at a retail location, it can be readily converted into a product display tray. This is accomplished by manually engaging the opening 92 in the front panel 18 above the perforation line 90, and manually separating the removable portion 85*a* of the hexagonal center portion 82 of the front panel 18 from the remaining portion 85*b* of the hexagonal center portion 82 of the front panel 18. At such a time, the manual activation of the perforation line 90 also separates the side flaps 84 and 86 into removable upper portions 84*a* and 86*a* and remaining lower portions 84*b* and 86*b*.

Figure 7:
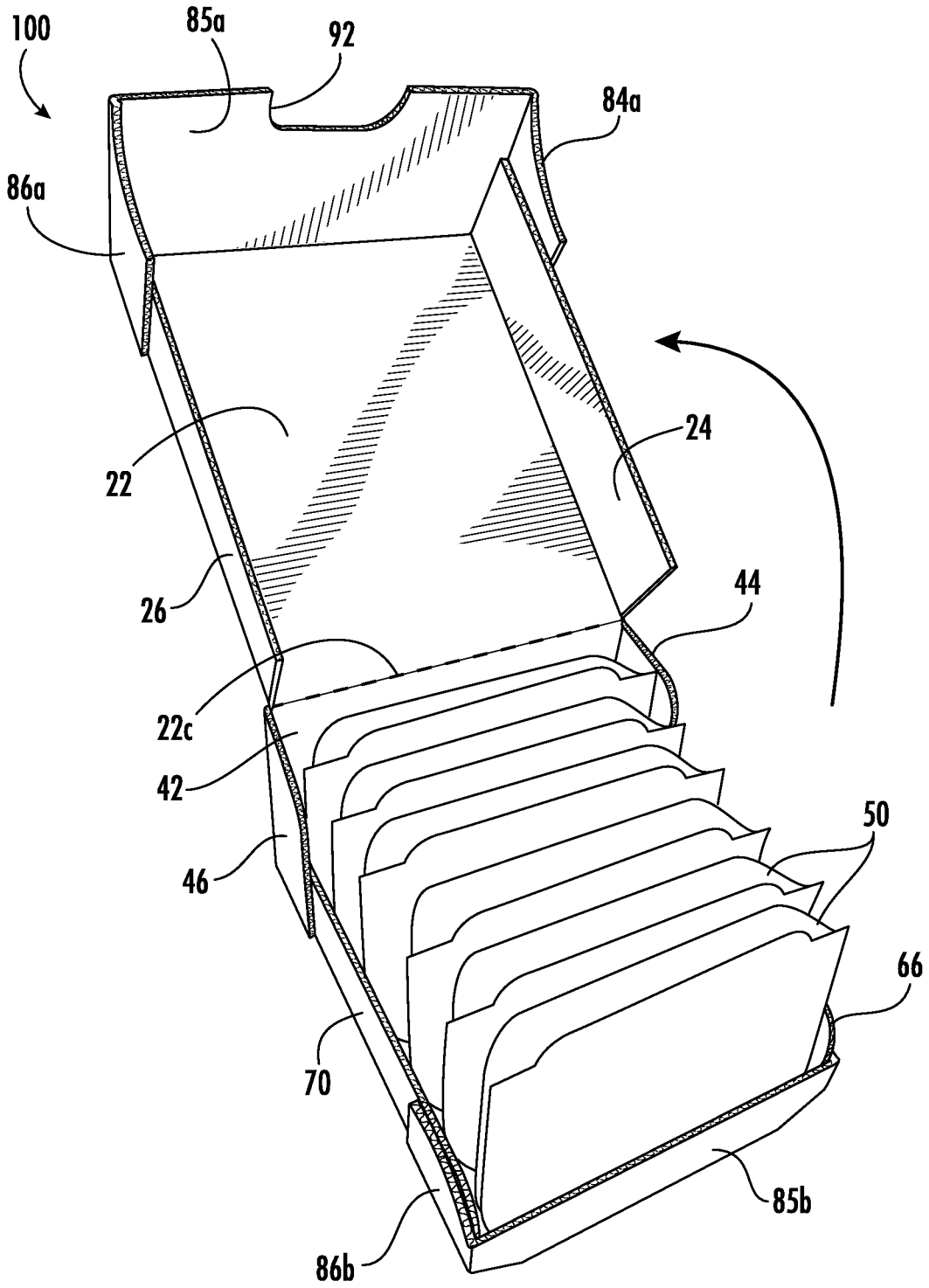
FIG. 7 is a perspective view of the retail ready package of FIG. 5, as the top half of the package is lifted away from the bottom half of the package, before the top panel is separated from the rear panel along a perforation line.

Thereafter, as shown in FIG. 7, the upper portion of the package is swung back along the perforated top rear edge 22*c* of the rear panel 14. And, because there is no glue in the junctions areas between the interfacing surfaces of the top and rear side flaps 24 and 44, as well as in the junction areas between the interfacing surfaces of the top and rear side flaps 26 and 46, there is no resistance to the ready removal of the top panel 12 from the rear panel 14 along the perforation line formed through the top rear edge 22*c*.

Figure 8:
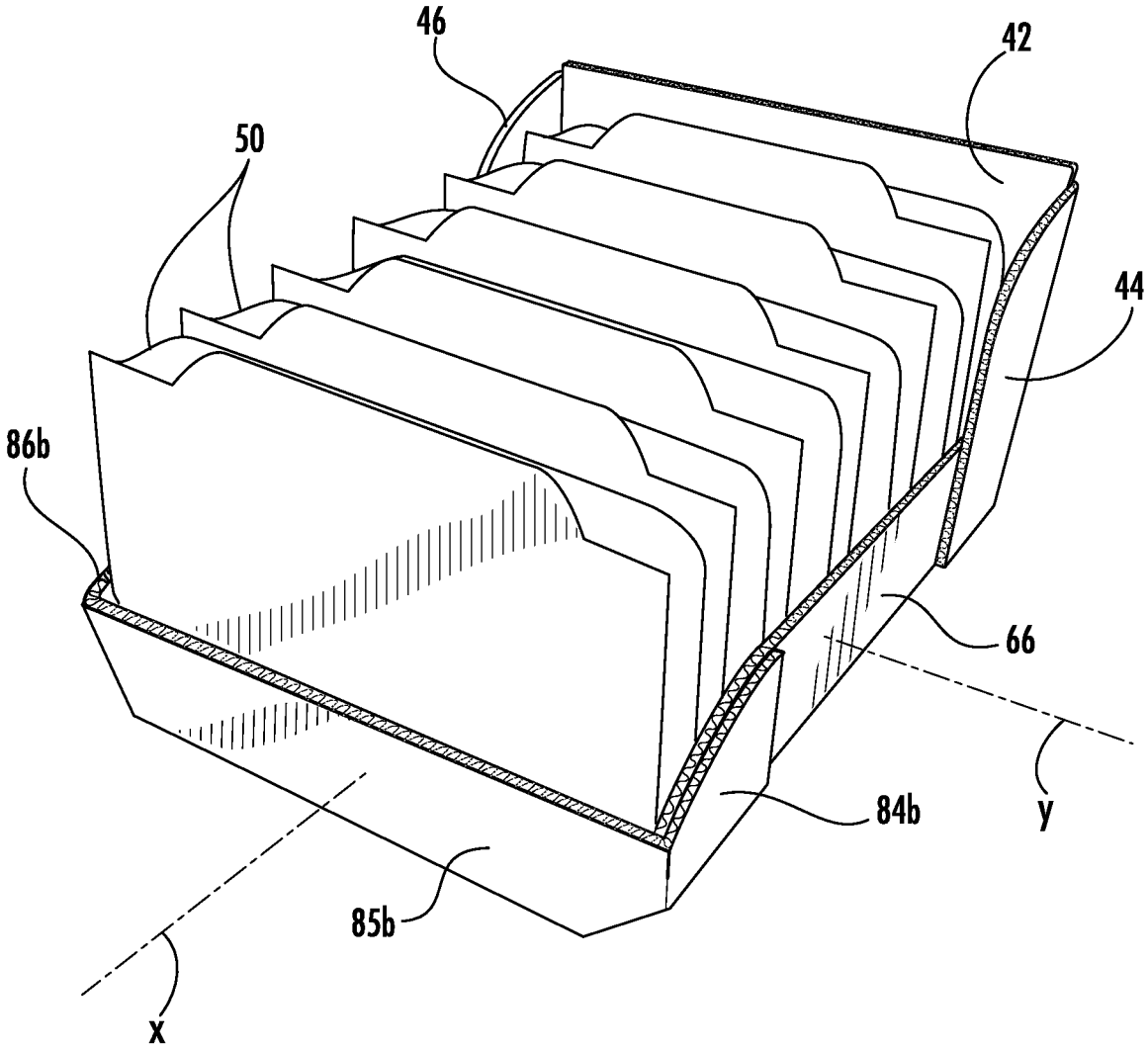
FIG. 8 is a perspective view of the package of FIG. 1, with the top half of the package separated from the bottom half of the package, wherein six-sided products are displayed in an upright position.

Once the top portion of the package 100 have been removed, the remaining portions of the package define an open-topped product display tray having a generally hexagonal shaped cross-section, which extends in a plane "Y" that is transverse to the longitudinal axis "X" of the package 100, which is best seen in FIG. 8. Moreover, the display tray is configured so that the plurality of six-sided products 50 contained therein are effectively cradled and maintained in an upright display position.

Figure 9:
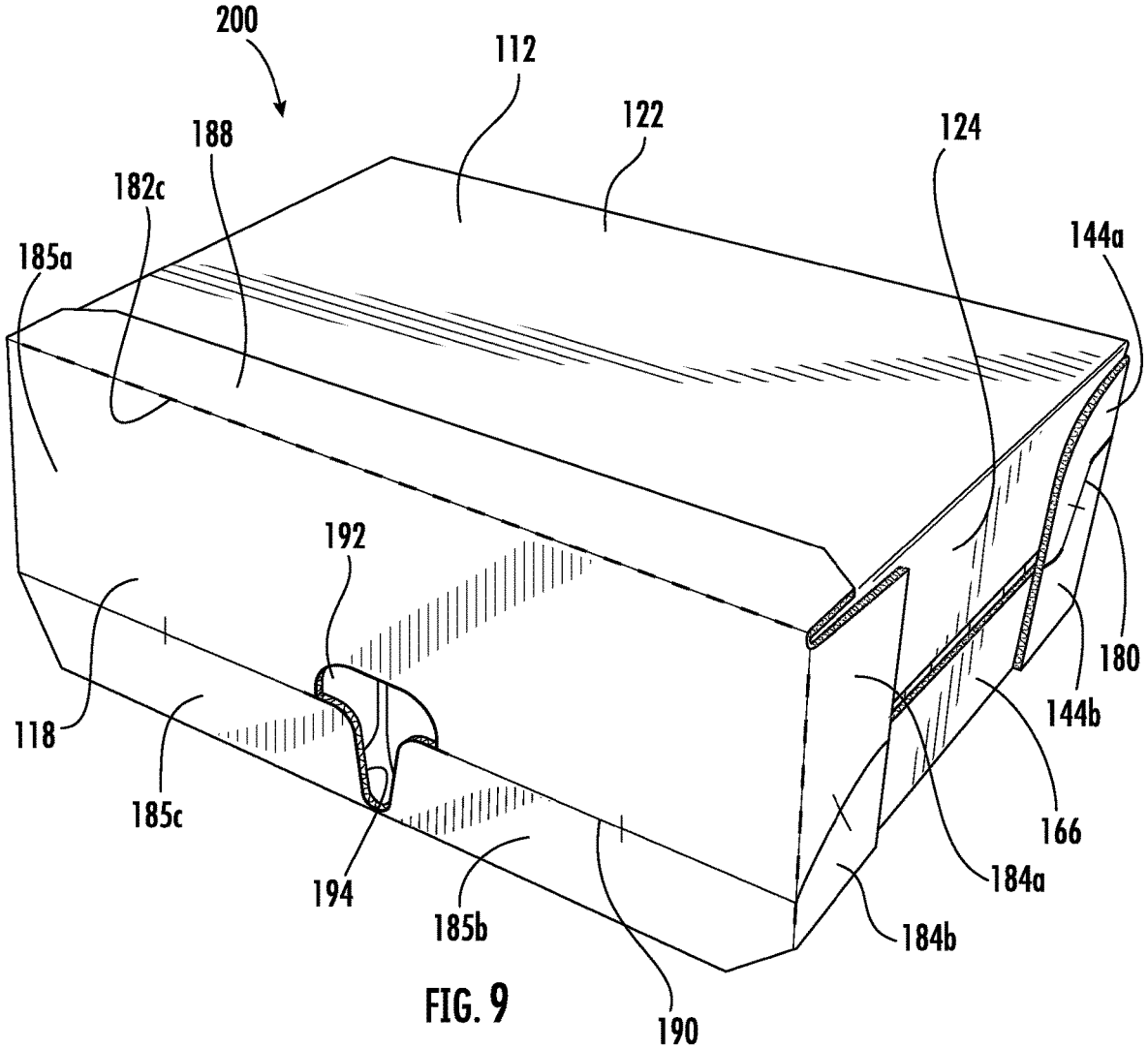
FIG. 9 is a perspective view of a splittable retail ready package constructed in accordance with the subject invention that is configured to ship and display six-sided products.

Referring now to FIG. 9, there is illustrated another retail ready package constructed in accordance with a preferred embodiment of the subject invention, which is designated generally by reference numeral 200. This package 200 is similar to the retail ready package 100 illustrated in FIG. 1, but the package 200 is adapted and configured to be split into two separate open-topped product display trays, as described in more detail below and shown for example in FIGS. 14 and 15. Like the previously described embodiment of the invention, the package 200 is adapted and configured for efficiently loading, shipping and subsequently displaying a plurality of six-sided products, such as frozen food containers, in an upright position on a shelf or display unit in a retail store.

Figure 10:
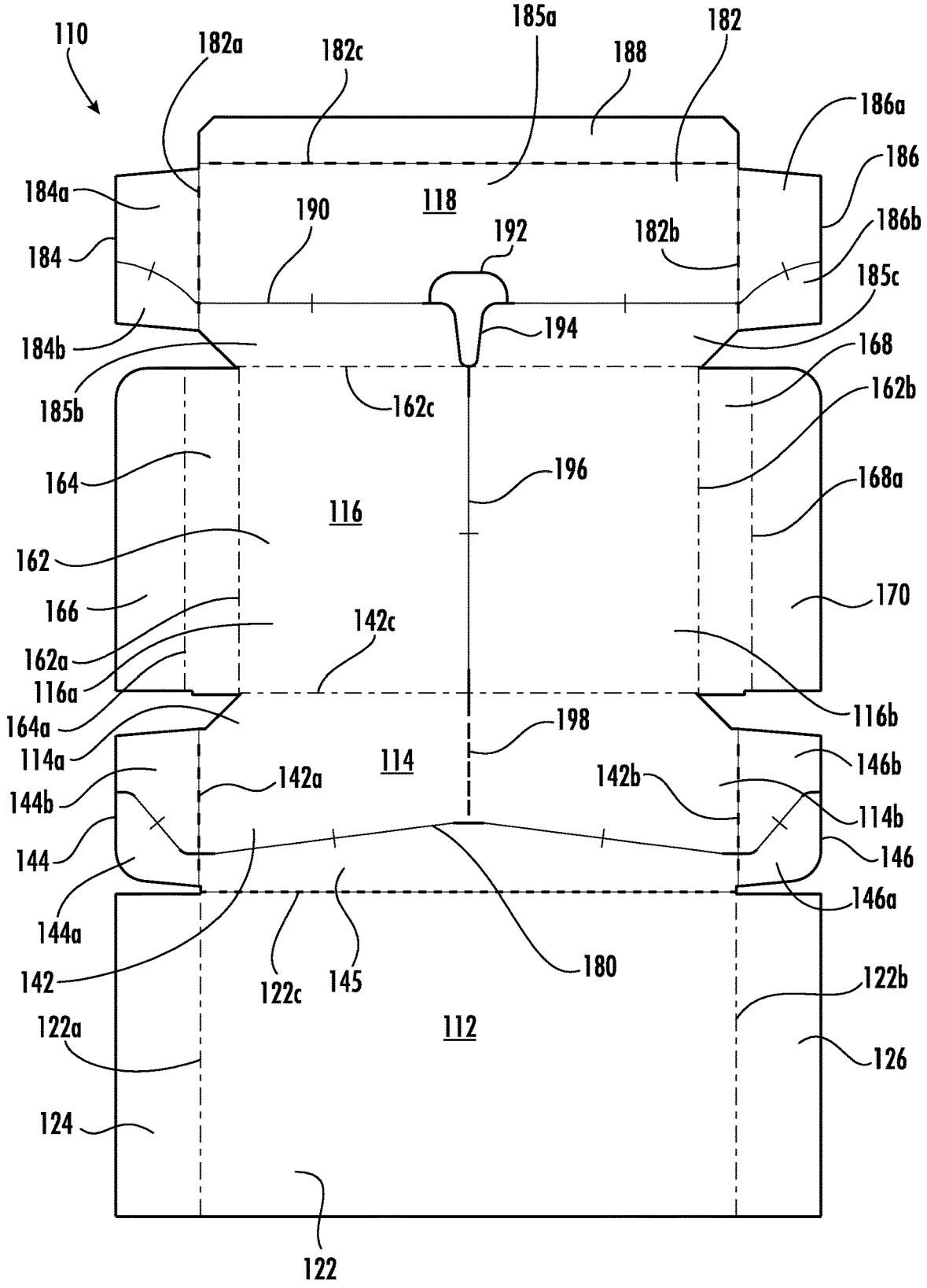
FIG. 10 is a plan view of a die-cut blank for forming the retail ready package shown in FIG. 9.

Referring now to FIG. 10, there is illustrated a die-cut cardboard blank 110 for forming the retail ready package 200 of the subject invention. The blank 110 includes a top panel 112 having a rectangular center portion 122, a first top side flap 124 foldably connected to a first side edge 122*a* of the rectangular center portion 122, and a second top side flap 126 foldably connected to a second side edge 122*b* of the rectangular center portion 122.

The blank 110 further includes a rear panel 114 having a hexagonal center portion 142 foldably connected to a perforated top rear edge 122*c* of the rectangular center portion 122 of the top panel 112, a first rear side flap 144 foldably connected to a first side edge 142*a* of the hexagonal center portion 142, and second rear side flap 146 foldably connected to a second side edge 142*b* of the hexagonal center portion 142. A perforation line 180 extends across the rear panel 144 through the first side flap 144, the hexagonal center portion 142 and the second side flap 146 thereof to divide the first side flap 144 into a removable portion 144*a* and remaining portion 144*b*, to divide the second side flap 146 into a removable portion 146*a* and a remaining portion 146*b*, and to divide the center portion 142 into a removable portion 145 and a remaining half portions 114*a* and 114*b* bisected by a perforation line 198.

The blank 110 further includes a bottom panel 116 having a rectangular center portion 162 foldably connected to a bottom rear edge 142*c* of the hexagonal center portion 142 of the rear panel 114, a first inner side bottom panel 164 foldably connected to a first side edge 162*a* of the rectangular center portion 162 of the bottom panel 116, a first outer side flap 166 foldably connected to the first inner side bottom panel 164 along a fold line 164*a*, a second inner side bottom panel 168 connected to a second side edge 162*b* of the rectangular center portion 162 of the bottom panel 116, and a second outer side flap 170 foldably connected to the second inner side bottom panel 168 along a fold line 168*a*. The rectangular center panel 162 is bisected by a perforation line 196 that separates the bottom panel 116 into half-portions 116*a* and 116*b*.

The blank 10 further includes a front panel 118 having a hexagonal center portion 182 foldably connected to the a bottom front edge 162*c* of the rectangular center portion 162 of the bottom panel 116, a first front side flap 184 foldably connected to a first edge 182*a* of the hexagonal center portion 182 of the front panel 118, a second front side flap 186 foldably connected to a second edge 182*b* of the hexagonal center portion 182 of the front panel 118, and a front flap 188 foldably connected to a top front edge 182*c* the hexagonal center portion 182 of the front panel 118.

A perforation line 190 extends across the front panel 118 through the first side flap 184, the hexagonal center portion 182 and the second side flap 186 thereof to divide the first side flap 184 into a removable portion 184*a* and remaining portion 184*b*, to divide the second side flap into a removable portion 186*a* and a remaining portion 186*b*, and to divide the center portion 182 into a removable portion 185*a* and a bisected remaining portion that includes half-portions 185*b* and 185*c* separated by an opening 194. The perforation line 190 is interrupted by a central gap, where a hand-sized opening 192 is formed to aide in opening the perforation line 190. The openings 192 and 194 are contiguous.

Figure 11:
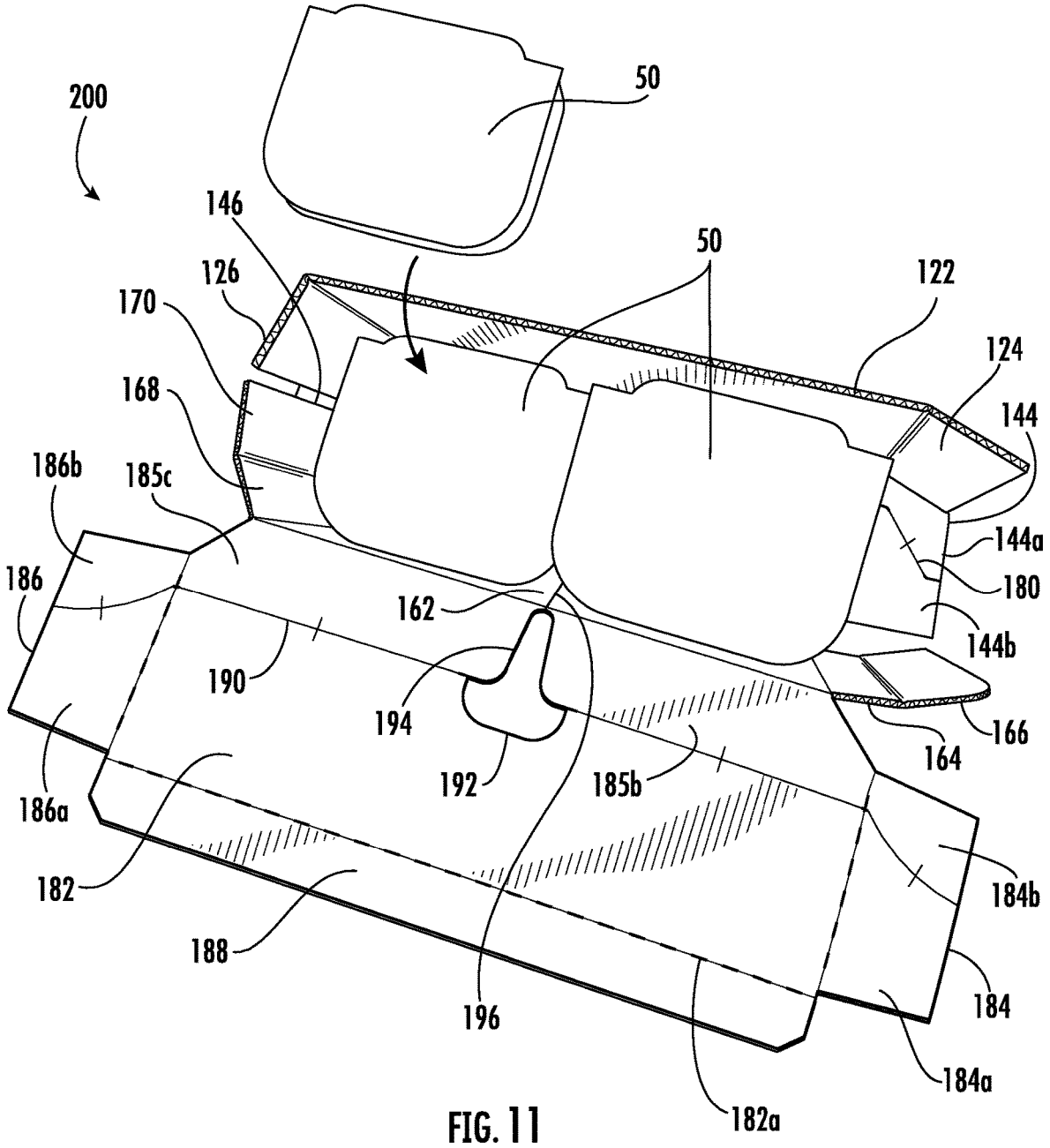
FIG. 11 is a perspective view of the splittable retail ready package partially constructed from the blank of FIG. 10, as six-sided products are loaded into the splittable package.
Figure 12:
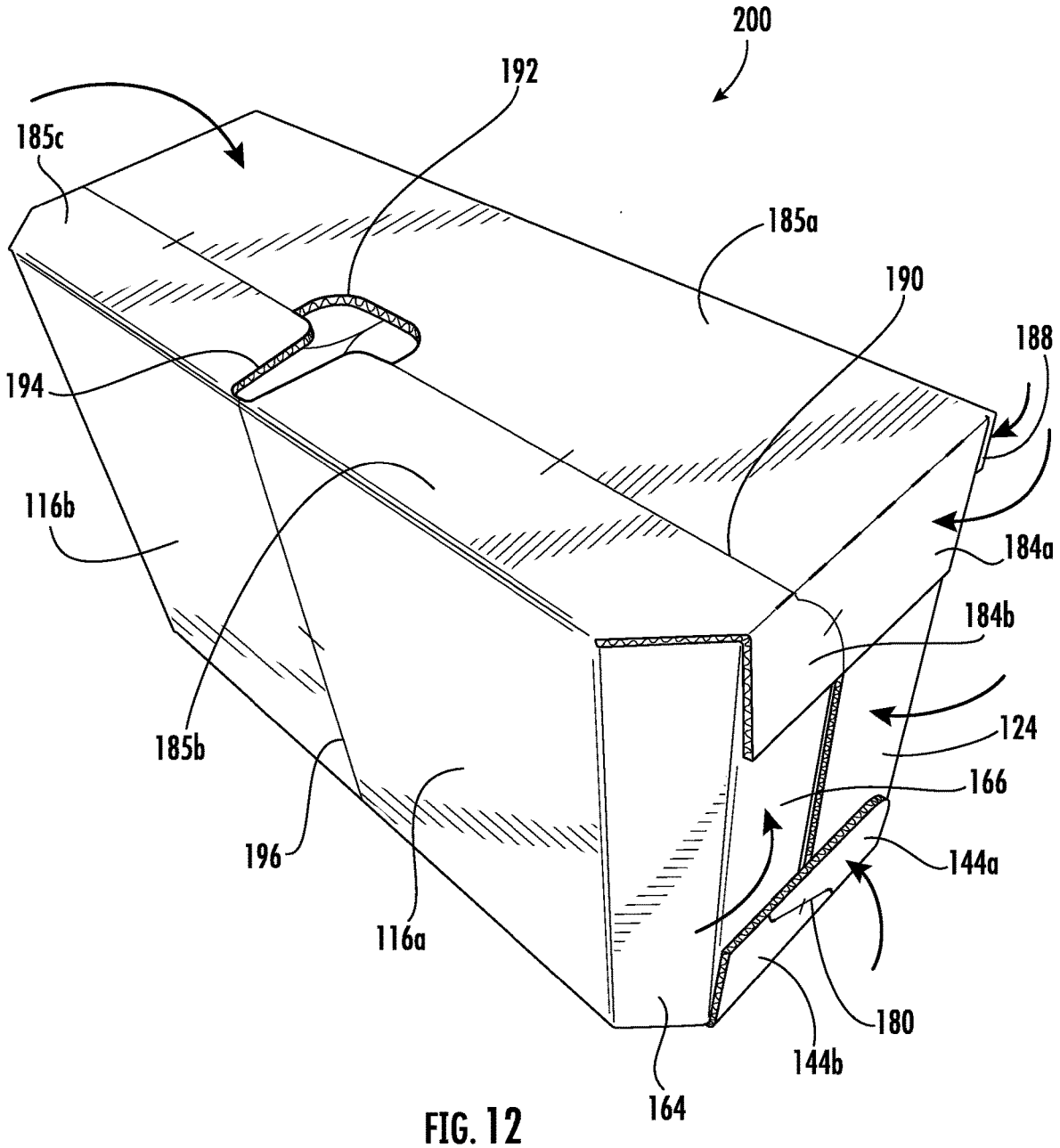
FIG. 12 is a perspective view of the retail ready package shown in FIG. 11, in an assembled and loaded condition ready for shipping.

Referring now to FIGS. 11 and 12, there is illustrated the steps of loading and forming the retail ready package 200 of the subject invention from the die-cut blank 110 shown in FIG. 10. Initially, the panels of the blank 110 are folded and erected into the unsealed loading condition shown in FIG. 11. Thereupon, a plurality of generally six-sided products, such as frozen food packages 50 are loaded into the unsealed carton 200, in two side-by-side rows. Thereafter, as shown in FIG. 12, the side flaps of the top and bottom panels 112 and 116 are folded into place and the side flaps 144 and 146 of the rear panel 114 are glued to adjacent interfacing outer surface portions of the top and bottom panels 112 and 116.

Figure 13:
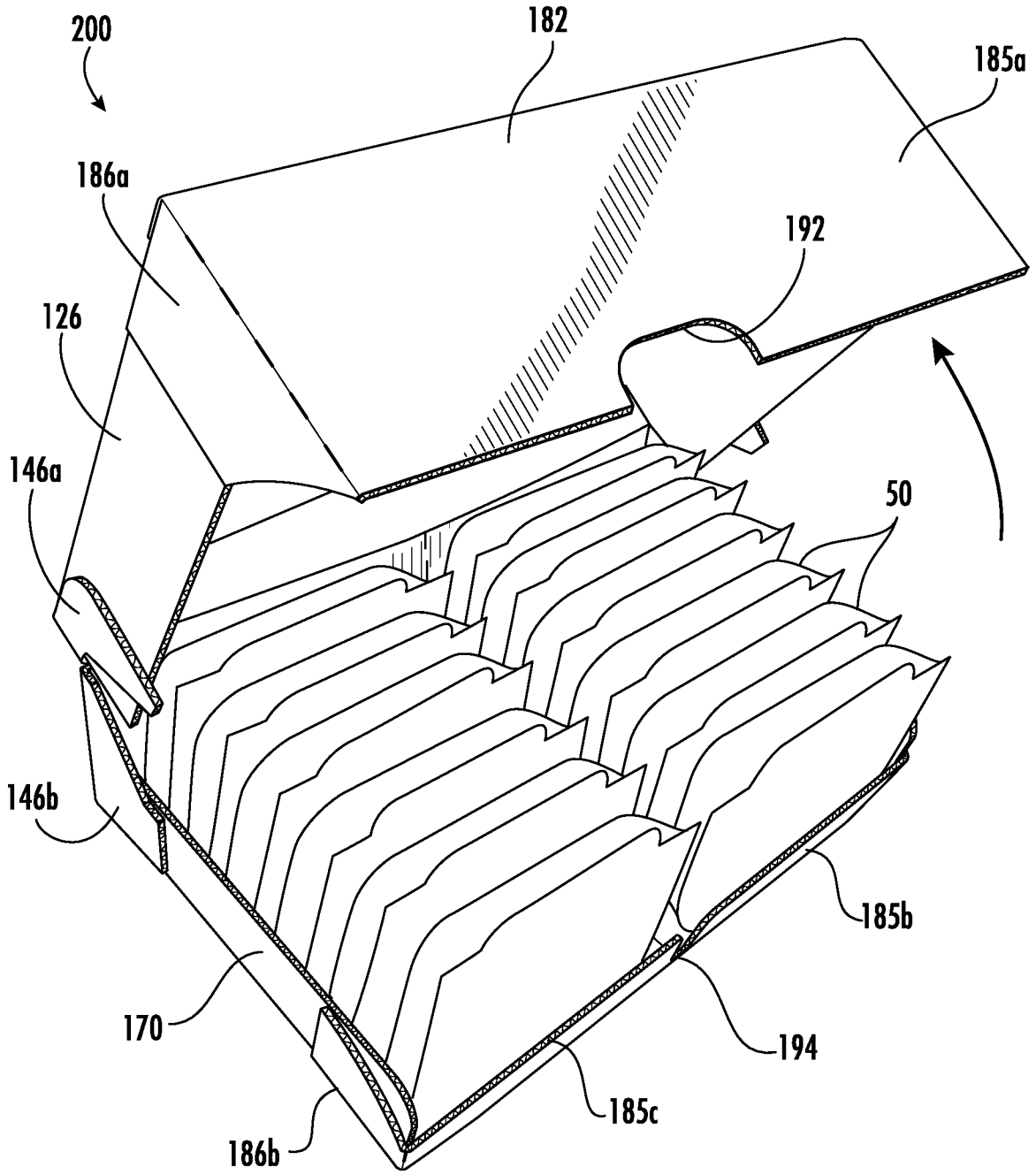
FIG. 13 is a perspective view of the retail ready package of FIG. 12, as the front panel is pulled upward to open the package, before the top panel is separated from the rear panel along a perforation line.

Once again, the junction areas between the top and rear side flaps remain free of glue to enable the removable upper portions of the package 200 to swing open relative to the remaining lower portions of the package 200 when the package is converted into a product display tray, as shown for example in FIG. 13. Finally, the front panel 118 is folded into place and the side flaps 184 and 186 thereof are glued to adjacent interfacing portions of the top and bottom panels 112 and 116, as shown in FIG. 12. At such a time, the fully loaded and sealed retail ready package 200 can be palletized and shipped.

Referring now to FIG. 13, when the package 200 arrives at a retail location, it can be readily converted into a product display tray. This is accomplished by manually engaging the opening 192 in the front panel above the perforation line 190, and manually separating the removable portion 185*a* of the hexagonal center portion 182 of the front panel 118 from the remaining portion 185*b* and 185*c* of the hexagonal center portion 182 of the front panel 118. At such a time, the manual activation of the perforation line 190 also separates the side flaps 184 and 186 into removable upper portions 184*a* and 186*a* and remaining lower portions 184*b* and 186*b*.

Thereafter, the upper portion of the package 200 is swung back along the top rear edge 122*c* of the rear panel 114. And, because there is no glue in the junctions areas between the interfacing surfaces of the top and rear side flaps 124 and 144, as well as in the junction areas between the interfacing surfaces of the top and rear side flaps 126 and 146, there is no resistance to the ready removal of the top panel 112 from the rear panel 114 along the perforation line formed through the top rear edge 122*c*.

Figure 14:
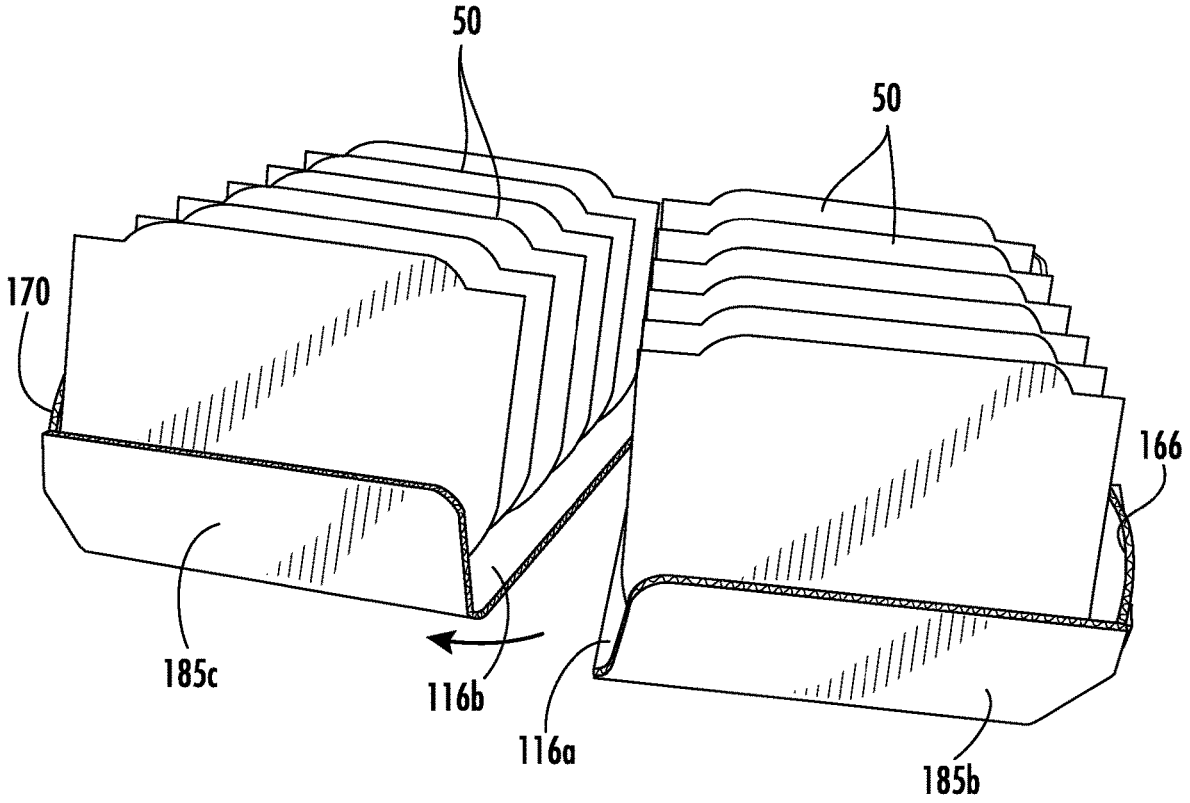
FIG. 14 is a perspective view of the retail ready package of FIG. 12, with the top half of the package separated from the bottom half of the package, and wherein the bottom panel of the package is split along a perforation line to form two trays.
Figure 15:
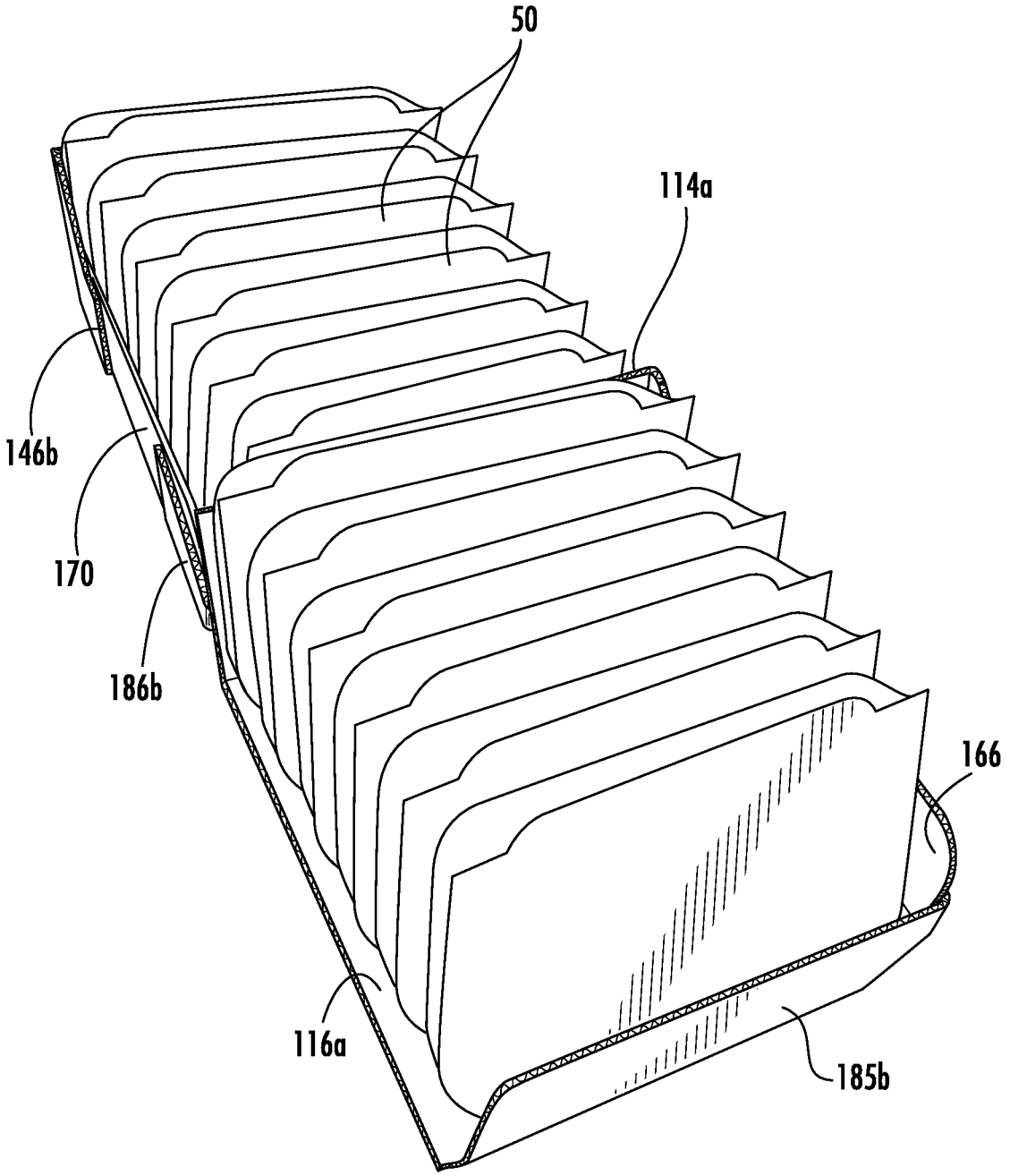
FIG. 15 is a perspective view as in FIG. 9, with two trays of six-sided products displayed in an upright position.

Referring to FIG. 14, once the top portions of the package 200 have been removed, the remaining portions of the package 200 define an open-topped product display tray having a generally hexagonal shaped cross-section that can be readily split into two separate open-topped display trays. More particularly, the bottom panel 116 can be split into half section 116*a* and 116*b* along perforation line 196, and the remaining portions of the rear panel 114 can be split into half sections 114*a* and 114*b* along perforation line 198, while the remaining portions 185*b* and 185*c* of the front panel 118 are already separated from one another by the opening 194. Once separated, the two open-topped trays can be aligned with one another, as shown in FIG. 15. At such a time, the six-sided products 50 contained in each tray section are effectively cradled and maintained in an upright display position.

Figure 16:
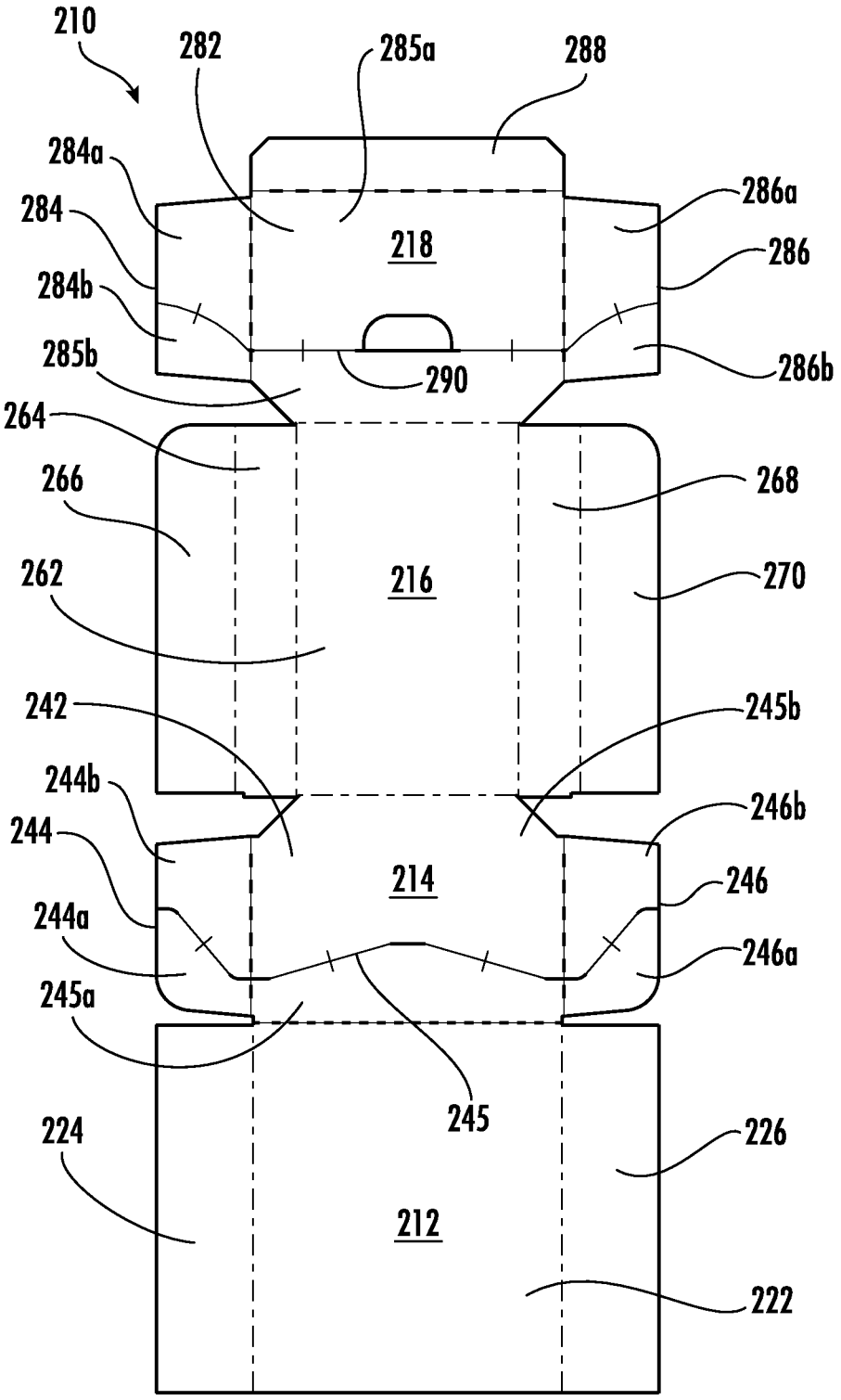
FIG. 16 is a plan view of a die-cut blank for forming a retail ready package that is configured to ship and display six-sided products, wherein the package has a lower back height than the package shown in FIG. 1.

Referring now to FIG. 16, there is illustrated a die-cut cardboard blank 210 for forming a retail ready package in accordance with the subject invention, which is similar to the package 100 shown in FIG. 1, but this blank will result in a package has a lower back height than the package shown in FIG. 1, as explained in more detail below.

The blank 210 includes a top panel 212 having a rectangular center portion 222, a first top side flap 224, and a second top side flap 126. The blank 110 further includes a rear panel 214 having a hexagonal center portion 242, a first rear side flap 244, and second rear side flap 246. A continuous perforation line 245 extends across the rear panel 214 through the first side flap 244, the hexagonal center portion 242 and the second side flap 246 thereof to divide the first side flap 244 into a removable portion 244*a* and remaining portion 244*b*, to divide the second side flap 246 into a removable portion 246*a* and a remaining portion 246*b*, and to divide the center portion 242 into a removable portion 245*a* and a remaining portions 245*b*, which creates the lower back height of the package mentioned above.

The blank 210 further includes a bottom panel 216 having a rectangular center portion 262, a first inner side bottom panel 264, a first outer side flap 266, a second inner side bottom panel 268, and a second outer side flap 270. The blank 210 further includes a front panel 218 having a hexagonal center portion 282, a first front side flap 284, a second front side flap 286, and a front flap 288. A perforation line 290 extends across the front panel 218 through the first side flap 284, the hexagonal center portion 282 and the second side flap 286 thereof to divide the first side flap 284 into a removable portion 284*a* and remaining portion 284*b*, to divide the second side flap into a removable portion 286*a* and a remaining portion 286*b*, and to divide the center portion 282 into a removable portion 285*a* and remaining portion 285*b*.

Figure 17:
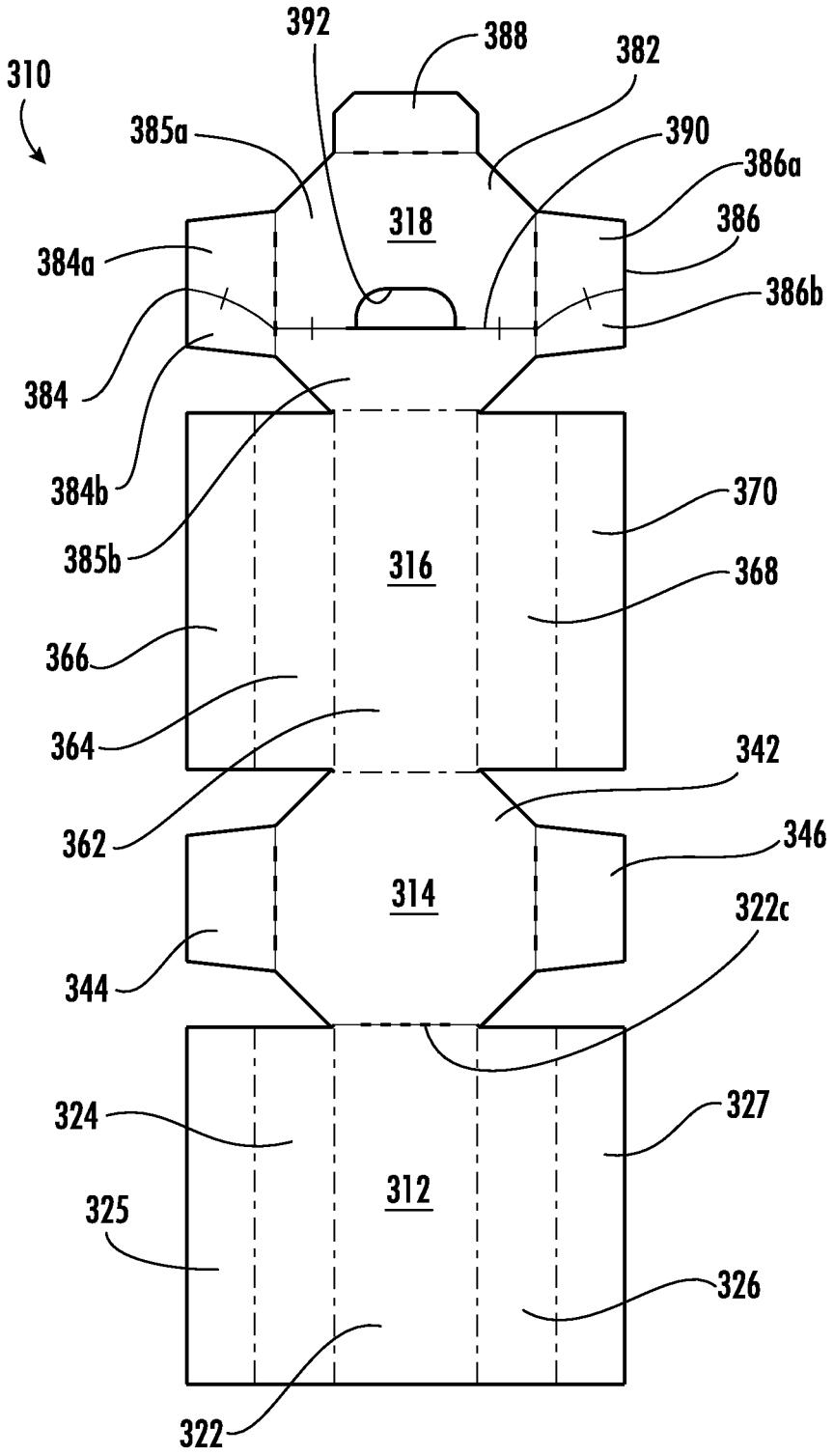
FIG. 17 is a plan view of a die-cut blank for forming a retail ready package that is configured to ship and display eight-sided products, wherein the package has a full back height.

Referring now to FIG. 17, there is illustrated a die-cut cardboard blank 310 for forming a retail ready package in accordance with the subject invention, which is similar to the package 100 shown in FIG. 1, but this blank will result in a package that has eight-sided front and rear panels, as explained in more detail below.

The blank 310 includes a top panel 312, a rear panel 314, a bottom panel 316 and a front panel 318. The top panel 312 has a rectangular center portion 322, first and second inner side flaps 324 and 326, and first second outer side flaps 325 and 327. The rear panel 314 has an octagonal center portion 342, a first rear side flap 344, and second rear side flap 346. The bottom panel 316 has a rectangular center portion 362, a first inner side bottom panel 364, a first outer side flap 366, a second inner side bottom panel 368, and a second outer side flap 370. The front panel 318 has an octagonal center portion 382, a first front side flap 384, a second front side flap 386, and a front flap 388.

A perforation line 390 extends across the front panel 318 through the first side flap 384, the octagonal center portion 382 and the second side flap 386 thereof to divide the first side flap 384 into a removable portion 384*a* and remaining portion 384*b*, to divide the second side flap into a removable portion 386*a* and a remaining portion 386*b*, and to divide the center portion 382 into a removable portion 385*a* and remaining portion 385*b*. The front panel 318 has an opening 392 therein for initiating the separation of the removable portions of the package from the remaining portions of the package along the perforation lines 390 and 322*c*.

When erecting a package from the blank 310, it is preferable not to include glue in the junction areas between top and rear side flaps 325 and 344, as well as the junction area between top and rear side flaps 327 and 346, so that the top portions of the package can swing freely relative to the bottom portions of the package when the package is converted into an open-topped tray.

Figure 18:
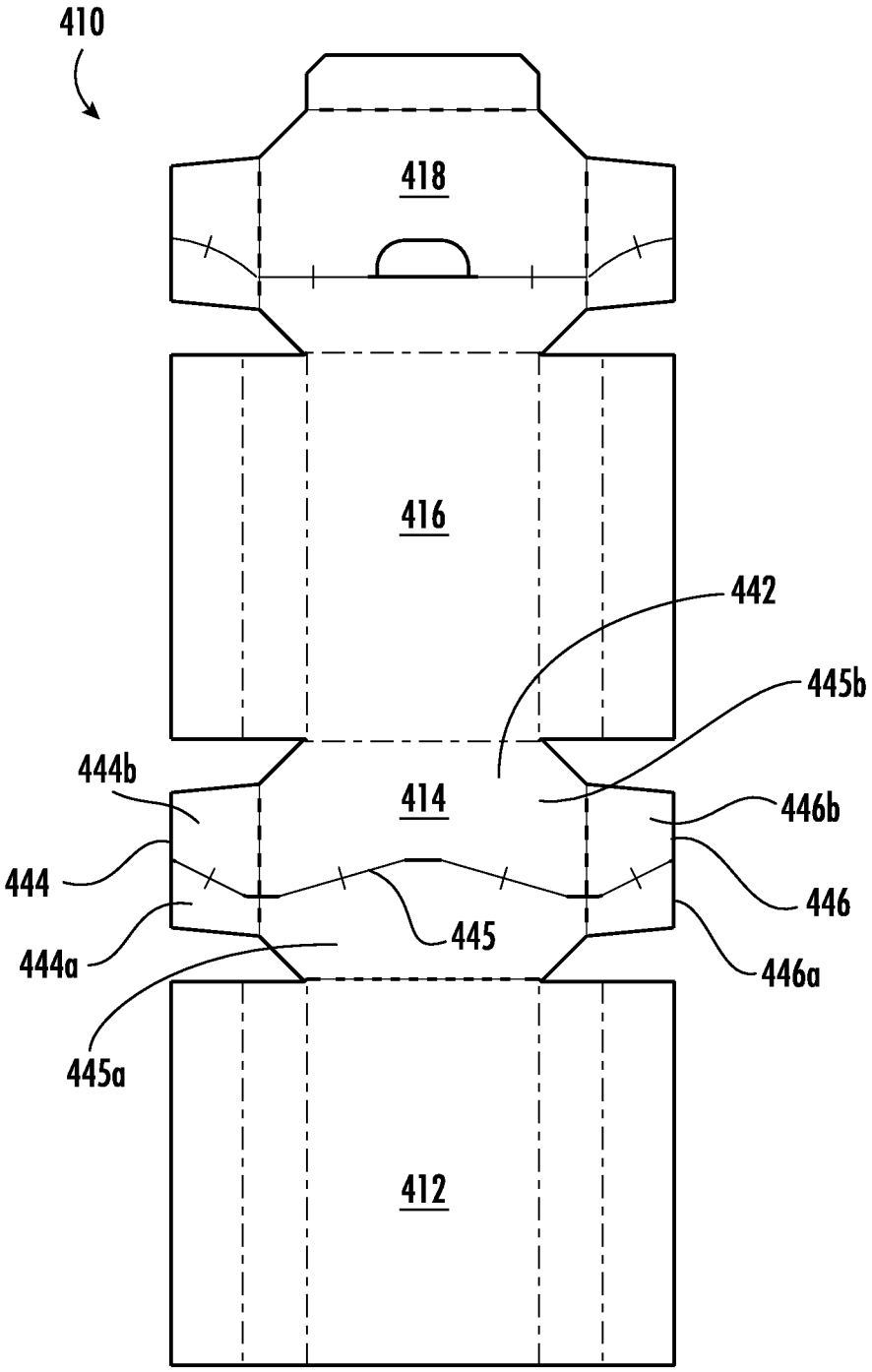
FIG. 18 is a plan view of a die-cut blank for forming a retail ready package that is configured to ship and display eight-sided products, wherein the package has a lower back height than the package formed from the blank of FIG. 17.

Referring now to FIG. 18, there is illustrated a die-cut cardboard blank 410 for forming a retail ready package in accordance with the subject invention, which is similar to the package formed by blank 310 shown in FIG. 17, but this blank 410 will result in a package that has eight-sided front and rear panels, with the rear panel having a lower back height than the rear panel of the package formed by blank 310.

The blank 410 includes a top panel 412, a rear panel 414, a bottom panel 416 and a front panel 418. In this embodiment of the invention. A continuous perforation line 445 extends across the rear panel 414 through the first side flap 444, the octagonal center portion 442 and the second side flap 446 thereof to divide the first side flap 444 into a removable portion 444*a* and remaining portion 444*b*, to divide the second side flap 446 into a removable portion 446*a* and a remaining portion 446*b*, and to divide the center portion 442 into a removable portion 445*a* and a remaining portions 445*b*, which creates the lower back height of the package mentioned above.

Figure 19:
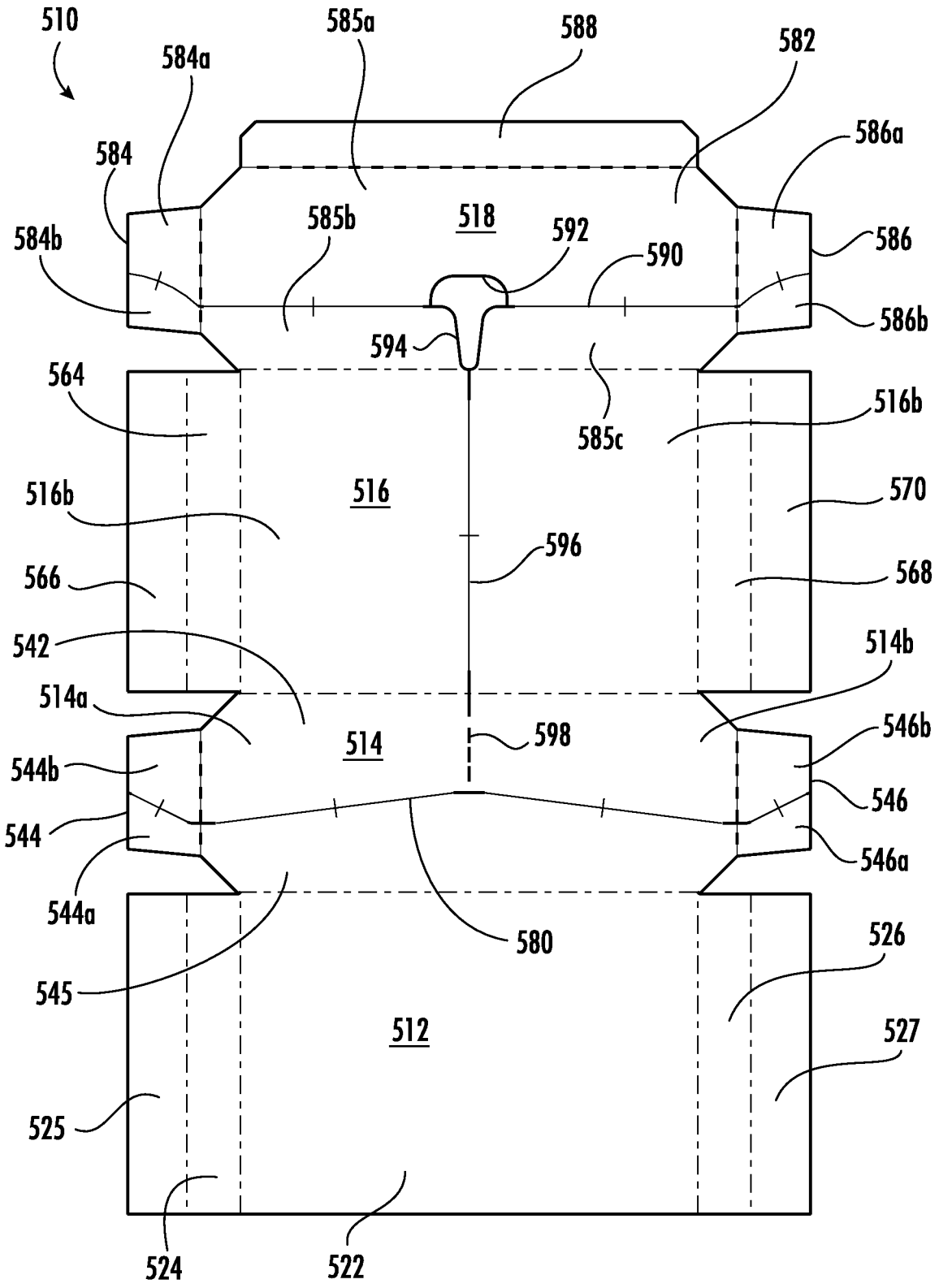
FIG. 19 is a plan view of a die-cut blank for forming a splittable retail ready package that is configured to ship and display eight-sided products in an upright position.

Referring now to FIG. 19, there is illustrated a die-cut cardboard blank 510 for forming a splittable retail ready package similar to that shown in FIG. 9, but with eight-sided front and rear panels. The blank 510 includes a top panel 512, a rear panel 514, a bottom panel 516 and a front panel 518.

The top panel 512 has a rectangular center portion 522, first and second inner side flaps 524 and 526, and first second outer side flaps 525 and 527. The rear panel 514 has an octagonal center portion 542, a first rear side flap 544, and second rear side flap 546. A perforation line 580 extends across the rear panel 514 through the first side flap 544, the octagonal center portion 542 and the second side flap 546 thereof to divide the first side flap 544 into a removable portion 545 and remaining portions 514*a* and 514*b* bisected by a score line 598.

The bottom panel 516 has a rectangular center portion 562, a first inner side bottom panel 564, a first outer side flap 566, a second inner side bottom panel 568, and a second outer side flap 570. The bottom panel 516 is bisected by a perforation line 596 that divides the panel 516 into half portions 516*a* and 516*b*. The front panel 518 has an octagonal center portion 582, a first front side flap 584, a second front side flap 586, and a front flap 588.

A perforation line 590 extends across the front panel 518 through the first side flap 584, the octagonal center portion 582 and the second side flap 586 thereof to divide the first side flap 584 into a removable portion 584*a* and remaining portion 584*b*, to divide the second side flap into a removable portion 586*a* and a remaining portion 586*b*, and to divide the center portion 582 into a removable portion 585*a* and a bisected remaining portion that includes half-portions 585*b* and 585*c* separated by an opening 594. The perforation line 590 is interrupted by a central gap, where a hand-sized opening 592 is formed to aide in opening the perforation line 590.

The unique three-dimensional shape of the retail ready packages of the subject invention, with their six-sided or eight-sided front and rear panels, provide certain benefits. For example, when a plurality of these packages are shipped together on a pallet in a refrigerated transport container, the openings or gaps formed between the oppositely angled corners of adjacent packages will allow cold air to flow throughout the pallet, ensuring that frozen food items within the pallet will remain a sufficiently low temperature to prevent the food items from thawing.

While the subject disclosure has been shown and described with reference to preferred embodiments, those skilled in the art will readily appreciate that changes or modifications may be made thereto without departing from the spirit or scope of the subject disclosure.

What is claimed is:

1. A blank for forming a retail ready package, comprising: a) a top panel having a rectangular center portion, a first top side flap foldably connected to a first side edge of the rectangular center portion, and a second top side flap foldably connected to a second side edge of the rectangular center portion; b) a rear panel having a center portion with at least six sides foldably connected to a top rear edge of the rectangular center portion of the top panel, a first rear side flap foldably connected to a first side edge of the center portion of the rear panel, and second rear side flap foldably connected to a second side edge of the center portion of the rear panel; c) a bottom panel having a rectangular center portion foldably connected to a bottom rear edge of the center portion of the rear panel, a first inner side bottom portion foldably connected to a first side edge of the rectangular center portion of the bottom panel, a first outer side bottom portion foldably connected to the first inner side bottom portion, a second inner side bottom portion connected to a second side edge of the rectangular center portion of the bottom panel, and a second outer side bottom portion foldably connected to the second inner side bottom portion; and d) a front panel having a center portion with at least six sides foldably connected to a bottom front edge of the rectangular center portion of the bottom panel, a first front side flap foldably connected to a first edge of the center portion of the front panel, a second front side flap foldably connected to a second edge of the center portion of the front panel, and a front flap foldably connected to a top front edge the center portion of the front panel, wherein a perforation line extends across the front panel through the first side flap, the center portion and the second side flap thereof, to define a removable part of the front panel and a remaining part of the front panel, and wherein the center portion of the rear panel is foldably connected to the top rear edge of the rectangular center portion of the top panel along a top perforation line to facilitate a separation of the top panel from the rear panel together with the removable part of the front panel.

2. A blank as recited in claim 1, wherein a gap interrupts the perforation line within the center portion of the front panel.

3. A blank as recited in claim 2, wherein a perforation line extends across the rear panel through the first side flap, the center portion and the second side flap thereof, to define a removable part of the rear panel.

4. A blank as recited in claim 3, wherein a perforation line bisects the center portion of the bottom panel.

5. A blank as recited in claim 4, wherein a perforation line bisects the center portion of the rear panel between the perforation line in the rear panel and the bottom rear edge of the center portion of the bottom panel.

6. A blank as recited in claim 2, wherein an opening is formed in the center portion of the front panel above the gap in the perforation line to aide in opening the perforation line.

7. A blank as recited in claim 3, wherein an opening is formed in the center portion of the front panel below the gap in the perforation line to aide in splitting the front panel in half.

8. A blank as recited in claim 1, wherein the center portion of the rear panel and the center portion of the front panel both have six sides.

9. A blank as recited in claim 1, wherein the center portion of the rear panel and the center portion of the front panel both have eight sides.

10. A blank as recited in claim 1, wherein the top panel further includes a first outer top side flap foldably connected to an outer side edge of the first top side flap, and a second outer top side flap foldably connected to an outer side edge of the second top side flap.

11. A retail ready package for shipping and displaying products, comprising: front and rear panels each having at least six sides and being spaced apart from one another along a longitudinal axis of the package when the package is in a shipping condition, wherein the front and rear panels each have a perforation line associated therewith that facilitate a conversion of the package into an open-topped product display tray having a generally hexagonal shaped cross-section, which extends in a plane that is transverse to the longitudinal axis of the package, wherein the package further includes a bottom panel that has a longitudinal perforation line to facilitate a separation of the product display tray into two separate open-topped trays.

12. A retail ready package as recited in claim 11, wherein the front and rear panels both have six sides.

13. A retail ready package as recited in claim 11, wherein the front and rear panels both have eight sides.

14. A retail ready package as recited in claim 11, wherein the perforation line associated with the front panel delineates a removable front panel portion and a remaining front panel portion.

15. A retail ready package as recited in claim 11, wherein the front panel includes an opening above the perforation line associated therewith for aiding in opening the perforation line to facilitate the conversion of the package into an open-topped product display tray.

16. A retail ready package as recited in claim 11, wherein the perforation line associated with the rear panel facilitates separation of the rear panel from a top panel of the package.

17. A retail ready package as recited in claim 11, wherein the perforation line associated with the rear panel delineates a removable rear panel portion and a remaining rear panel portion.

18. A retail ready package as recited in claim 11, wherein the front panel includes a central gap and the rear panel includes a central perforation line in the remaining portion thereof to facilitate the separation of the product display tray into two separate open-topped trays.

19. A retail ready package as recited in claim 11, wherein a plurality of products are contained within the package for shipment and subsequent display in the open-topped product display tray.

* * * * *